US006513462B1

(12) United States Patent
Shiraishi et al.

(10) Patent No.: US 6,513,462 B1
(45) Date of Patent: Feb. 4, 2003

(54) DESCALING DEVICE FOR STEAM GENERATOR

(75) Inventors: Tadashi Shiraishi, Hyogo (JP); Takehiko Ichioka, Hyogo (JP); Hideya Okada, Hyogo (JP); Fumitoshi Nakao, Hyogo (JP); Toshiyuki Kinugasa, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/937,600

(22) PCT Filed: Feb. 3, 2000

(86) PCT No.: PCT/JP00/00593

§ 371 (c)(1),
(2), (4) Date: Sep. 28, 2001

(87) PCT Pub. No.: WO01/57462

PCT Pub. Date: Aug. 9, 2001

(51) Int. Cl.[7] ..... F22B 37/54
(52) U.S. Cl. ..... 122/382; 122/390; 376/316
(58) Field of Search ..... 122/459, 460, 122/379, 390, 405, 382; 134/167 R, 198; 376/316

(56) References Cited

U.S. PATENT DOCUMENTS

| | | | | |
|---|---|---|---|---|
| 5,036,871 | A | | 8/1991 | Ruggieri |
| 5,065,703 | A | * | 11/1991 | Lee ..... 122/382 |
| 5,286,154 | A | | 2/1994 | Lee et al. |
| 5,341,406 | A | | 8/1994 | Jens et al. |
| 5,764,717 | A | | 6/1998 | Rootham |
| 5,841,826 | A | | 11/1998 | Rootham |

FOREIGN PATENT DOCUMENTS

| | | |
|---|---|---|
| JP | 4-10296 | 1/1992 |
| JP | 4-108135 | 9/1992 |
| JP | 5-52592 | 7/1993 |
| JP | 5-196791 | 8/1993 |
| JP | 6-55084 | 7/1994 |
| JP | 7-181136 | 7/1995 |
| JP | 9-26107 | 1/1997 |
| JP | 10-253290 | 9/1998 |
| JP | 2812521 | 10/1998 |
| WO | 90/09850 | 9/1990 |
| WO | 97/08107 | 3/1997 |

* cited by examiner

*Primary Examiner*—Gregory Wilson
(74) *Attorney, Agent, or Firm*—Wenderoth, Lind & Ponack, L.L.P.

(57) ABSTRACT

A scale removing device for removes scale adhering to the interior of a shell-and-tube-heat-exchanger-type steam generator. The scale removing device is provided with a flexible lance (58) holding a high-pressure water hose (91) movable with respect to a tube plate, tube support plates, and heat-transfer tubes. A cleaning head (60) is mounted to the forward end of the flexible lance. Formed inside the cleaning head is a cavitation generating nozzle hole **(99*a*, 99*b*)** communicating with the high-pressure water hose. Bubbles are generated at the time of cleaning, and the impact pressure generated when the bubbles collapse is propagated to remove scale over a wide range.

13 Claims, 14 Drawing Sheets

DESCALING DEVICE FOR STEAM GENERATOR

TECHNICAL FIELD

The present invention relates to a removing device for removing sludge or scale, for example, on a tube plate and a tube nest of a heat exchanger such as a steam generator used in a nuclear power plant or the like.

BACKGROUND ART

In order to understand the present invention, a description of a steam generator used in a nuclear power plant or the like is necessary. Thus, such a steam generator will be briefly described with reference to FIG. 10.

In FIG. 10, numeral 1 indicates a steam generating portion of a steam generator. The steam generating portion 1 has a substantially cylindrical body portion 2 in which hand holes or inspection holes (only one of which is indicated at numeral 17) are diametrically opposed to each other. In the lower portion of the body portion 2, there is arranged a tube plate 3, which defines, together with a bottom portion 2*a* of the body portion 2, a water chamber 4. Above this tube plate 3, a large number of normally U-shaped heat-transfer tubes 5 are arranged so as to communicate with the water chamber 4. Further, a plurality of tube support plates 6*a*, 6*b*, . . . , 6*f* are horizontally arranged so as to traverse the large number of heat-transfer tubes 5 and laterally support them. Each of the heat-transfer tubes 5 extends vertically through oddly shaped holes usually called BEC (Broached Egg Crate) holes formed in the tube support plates 6*a*, 6*b* . . . , 6*f*. In FIG. 10, some of the BEC holes formed in the tube support plate 6*a* are schematically shown and indicated by numeral 7.

The space in the water chamber 4 is divided into a hot leg portion 4*a* and a cold leg portion 4*b* by a partition 8. One end of each U-shaped heat-transfer tube 5 communicates with the hot leg portion 4*a*, and the other end thereof communicates with the cold leg portion 4*b*. Thus, the tube plate 3 also has a large number of holes which are schematically indicated by numeral 3*a* and which serve to receive the end portions of each of the heat-transfer tubes.

Further, in FIG. 10, numeral 9 indicates a man-hole which enables an operator to enter the water chamber 4, numeral 10 indicates a coolant inlet nozzle communicating with the hot leg portion 4*a*, numeral 11 indicates a coolant outlet nozzle communicating with the cold leg portion 4*b*, and numeral 12 indicates trunnions for suspending the steam generator. Though not shown, a steam outlet is formed at the top of the steam generator. Further, above the steam generating portion 1, there is provided a water supply nozzle (not shown) for introducing supply water into the body portion.

In the case, for example, of a steam generator of a nuclear power plant, coolant at high temperature and high pressure supplied from the nuclear reactor enters the hot leg portion 4*a* of the water chamber 4 through the coolant inlet nozzle 10 and flows through the heat-transfer tubes 5 to reach the cold leg portion 4*b* before it is returned to the nuclear reactor by way of the coolant outlet nozzle 11. Supply water from the water supply nozzle is supplied into the body portion 2 to fill the periphery of the heat-transfer tubes 5. This supply water is heated by the high-temperature/high-pressure coolant flowing through the heat-transfer tubes 5 to become steam, which goes out through the steam outlet and is supplied to a steam turbine (not shown) for power generation.

As a result of the conversion of supply water into steam, impurities called scale are likely to adhere to the top surface of the tube plate 3, in particular, to the portions of the top surface of the tube plate 3 in the vicinity of the holes 3*a* into which the end portions of the heat-transfer tubes 5 are inserted and to the peripheral surfaces of the lower portions of the heat-transfer tubes 5 embedded in the tube plate 3. In this specification, these regions will be referred to as "the portion centered about the tube plate". Further, scale is likely to adhere to the upper and lower surfaces of each tube support plate, the regions near the portions directly below the BEC holes 7. In this specification, these regions will be referred to as "the portions centered about the tube support plates". If neglected, this scale will lead to corrosion of the heat-transfer tubes, etc. Thus, it must be periodically removed.

In this way, steam generators, which find relatively wide use in various fields of industry, involve, as they are used, the generation of impurities called scale on the heat-transfer tubes 5, the tube plate 3, the tube support plates 6*a*, 6*b*, . . . , 6*f*, etc. To maintain the performance of the steam generator and to prevent corrosion or the like due to scale, it is necessary to remove this scale.

For this purpose, various scale removing devices have been developed and proposed. In the case of a steam generator for a nuclear power plant, care must be taken, from a health care perspective, that an operator is not exposed to a dose of radiation greater than a predetermined level. Further, despite the fact that a steam generator is an apparatus of a considerably large size, the very large number of heat-transfer tubes are packed very tight. Furthermore, each heat-transfer tube has a diameter as small as approximately 20 mm, and is relatively thin-walled. Thus, the heat-transfer tubes are subject to damage if a heavy impact is applied thereto. In addition, a plurality of tube support plates are provided in the steam generator, and the distance between adjacent tube support plates is short in comparison to the height of the entire steam generator. These conditions have to be taken into account when developing a scale removing device.

As described above, a steam generator has only one tube plate, whereas it has a plurality of tube support plates. Thus, to clean the areas centered about the tube support plates, the cleaning head of a scale removing device has to ascend and descend through flow slots formed in the tube support plates (e.g., thin and narrow slots 13 formed in the tube support plate 6*a* shown in FIG. 10). In view of this, a scale removing device for cleaning the portion centered about the tube plate and a scale removing device for cleaning the portions centered about the tube support plates have been separately developed.

FIG. 11 shows a typical scale removing device for cleaning the portion centered about the tube plate, as disclosed in Japanese Patent Application Laid-Open No. 4-503564. The scale removing device, generally indicated at 15, is laterally inserted into a tube lane 16 directly above the tube plate 3 of a steam generator through a hand hole or inspection hole 17. The device includes a transporter 20 adapted to move along a support rail 18. A flexible lance 19 extends through this transporter 20 to a desired cleaning position between tube rows.

FIG. 12 shows in detail the flexible lance 19 and, in particular, a cleaning head 26 provided at the forward end thereof. The flexible lance 19 includes four high-pressure hoses 22 fixed together by a member 25 called a hose bar structure, a nitrogen purge line 23, and a video probe optical fiber cable 24, the forward ends of these components being connected to the cleaning head 26. Provided at the forward end of the cleaning head 26 are a plurality of nozzles 27 communicating with the high-pressure hoses 22. During cleaning, water 28 is jetted out from these nozzles (See FIG. 11).

FIG. 14 shows a typical example of a scale removing device for cleaning the portions centered about the tube support plates, as disclosed in Japanese Patent Application Laid-Open No. 9-026107 by the present applicant. This scale removing device, generally indicated at 30 in FIG. 14, is provided with an insertion mechanism 31 and a guide mechanism 32. The insertion mechanism 31 has on the operator side a driving device 33. Further, it has a fixation plate 34 at its forward end, which is fixed in position by the operation of a second jack 35. A receiving plate 36 and a first jack 37 are provided between the operator-side end and the forward end, whereby the direction of the guide mechanism 32 is changed upwards by 90 degrees. The guide mechanism 32 is divided into a large number of strip-like holding plates 38 so that the mechanism can move in a curve, and a high-pressure hose and an electric wire cable 29 can be mounted to the backsurface of the guide mechanism 32. A cleaning portion main body 40 is provided at the forward end of the guide mechanism 32, and a cleaning head 41 provided there is capable of rotating by 180 degrees.

Though not shown, this cleaning head 41 also has a plurality of nozzles, from which water is ejected to a portion to be cleaned. Through expansion and contraction of this guide mechanism 32, the scale removing device is passed through the flow slots 13 of the tube support plates to remove the scales in the areas centered about the plurality of tube support plates.

Regarding the removal of scale, there has been developed, apart from the technique which removes adhering scale by a water jet from the lance, a technique which aims to prevent adhesion of scale. Thus, in recent steam generators, the scale adhesion range is smaller as compared with that in conventional steam generators. Further, the adhesion thickness is much smaller. On the other hand, the adhesion force of adhering scale is very strong, and it is difficult to remove adhering scale by the above-mentioned water jet. FIG. 15 is a diagram showing an example of how scale adheres to a heat-transfer tube on the tube plate. Shown on the left-hand side of the center line of the heat-transfer tube is the scale (hard scale) adhering condition in a conventional steam generator, and, shown on the right-hand side thereof is the scale (hard scale) adhering condition in a recent steam generator.

In the prior-art techniques, to remove strongly adhering scale (called hard scale), the pressure of the water jet is increased. This has proved effective to some extent for scale which is in the water jet path. However, this is not effective at all for scale which is out of the water jet path, and such scale is allowed to remain. To remove such remaining scale, an attempt has been made to enlarge the width of the water jet path by providing a plurality of washing nozzles or to change the direction of water jets from the nozzles. However, the increase in ejection area has only resulted in a reduction in impact per unit area. Thus, removal of the remaining scale could not be realized as desired.

This will be explained in more detail with reference to FIG. 16. FIG. 16(*a*) is a perspective view showing an example of the cleaning head used. The cleaning head has eight nozzles A1 through A4 and A5 through A8 in the upper and lower portions of the front surface A thereof, and four nozzles B1 through B4 (nozzles B3 and B4 are not shown) at upper and lower positions in the side surfaces B thereof As shown in FIG. 16(*b*), this cleaning head is inserted between heat-transfer tubes 5, and water jets 28A and 28B are ejected from each of the nozzles of the front surface A and the side surfaces B of the cleaning head while drawing the cleaning head in the direction of the arrow to thereby perform cleaning. In this case, the regions where the water jets 28A and 28B hit are the regions that can be cleaned, and the other regions are out of the ejection paths. In FIG. 16(*b*), symbol Y indicates a direction which is perpendicular in a plane to the X-direction in which the tube lane 16 extends. Thus, numerals Y14, Y15, and Y16 indicate the fourteenth, fifteenth, and sixteenth heat-transfer tubes of the tube lane 16.

FIG. 16(*c*) is a plan view showing the ejection paths of the water jets 28A and 28B ejected as shown in FIG. 16(*b*). The central, wide shaded area is the region that can be cleaned by the water jets 28A, and the relatively narrow shaded areas on the right and left-hand sides thereof are regions that can be cleaned by the water jets 28B. It can be seen, in plan view, that there exist on the tube plate 3 regions which are out of the ejection paths. It has been difficult to remove scale in these regions out of the ejection paths. In FIG. 16(*d*), the region that can be cleaned by the water jets 28B are shown in shaded areas with respect to the height direction of the heat-transfer tube 5. It can be seen from this drawing that there also exist regions out of the ejection paths with respect to the height direction of the heat-transfer tube 5. In the prior art, it has been difficult to remove scale in these regions out of the ejection paths. In FIG. 16(*d*), the numerals given to the extension lines from the shaded areas indicate the numbers of the nozzles in the side surfaces B.

Accordingly, it is an object of the present invention to provide a scale removing device which makes it possible to solve the following problems in existing scale removing devices or which can satisfy the following requirements for existing scale removing devices:

(1) In order to remove the remaining hard scale, it is necessary for the cleaning liquid ejection range to cover the entire tube plate surface and a portion of the heat-transfer tube side wall up to a height of 10 mm or more as measured from the tube plate (including the regions which are out of the ejection path in the existing scale removing devices).

(2) The influence of ejection impact on the material is evaluated by using a locally strong portion as a reference, so that, for the cleaning effect to be high over a wide range, there should be no portion within the ejection range where the cleaning power is locally high. Otherwise, the cleaning conditions would be rather lenient.

(3) The effective cleaning diameter of an in-air water jet is small, so that it is difficult to enlarge the cleaning range with a cleaning nozzle incorporated in the lance.

DISCLOSURE OF THE INVENTION

To achieve the above object, there is provided, in a first aspect of the present invention, a scale removing device for a steam generator of the type which includes a body portion, a tube plate and a plurality of tube support plates arranged horizontally in the body portion so as to traverse the body portion. A plurality of heat-transfer tubes extend from the tube plate and end at the tube plate and extend through the tube support plates in a row-like fashion so as to define a tube lane in the body portion. A hand hole is formed at a position above the tube plate, through which the scale removing device is inserted to clean a portion centered about the tube plate. The scale removing device comprises a flexible lance holding a high-pressure water hose movable with respect to the tube plate and the heat-transfer tubes and a cleaning head mounted to the forward end of the flexible lance. Formed inside the cleaning head are a fluid passage communicating with the high-pressure water hose, a chamber communicating with the fluid passage, and a cavitation generating nozzle hole communicating with the chamber.

The scale removing device preferably further comprises a suspension guide device horizontally arranged above the tube plate and a lance conveying member suspended by the suspension guide device and guided in horizontal movement through the hand hole. The flexible lance runs through the lance conveying member and is paid out from and drawn back to the lance conveying member. The forward end portion of the cleaning head is formed in a curved surface not interfering with the body portion wall surface defining the hand hole.

Further, it is desirable that the lance conveying member have a cylindrical main body through which the flexible lance runs and that the forward end portion of the cleaning head is configured such that when the flexible lance has been completely drawn back, it does not protrude from the peripheral surface of the cylindrical main body. As desired, it is possible to form one or a plurality of the cavitation generating nozzle holes.

To achieve the above object, there is provided, in a second aspect of the present invention, a scale removing device for a steam generator including a body portion, a plurality of tube support plates horizontally arranged inside the body portion so as to traverse the body portion, and a plurality of heat-transfer tubes extending in a row-like fashion through the tube support plates so as to define a tube lane in the body portion. A pair of hand holes are formed in the body portion at a position directly above at least one of the tube support plates so as to be diametrically opposed to each other. Flow slots are formed in the portions of the tube support plates corresponding to the tube lane, the scale removing device being inserted through the hand holes, ascending and descending through the flow slots formed in the tube support plates, and cleaning the portions centered about the tube support plates. The scale removing device comprises a flexible lance holding a high-pressure water hose movable with respect to the tube support plates and the heat-transfer tubes, and a cleaning head mounted to the forward end of the flexible lance. Formed inside the cleaning head are a fluid passage communicating with the high-pressure water hose, a chamber communicating with the fluid passage, and a cavitation generating nozzle hole communicating with the chamber.

Further, the cleaning head includes a head main body portion in which the fluid passage and the chamber communicating with the fluid passage are formed, and a nozzle tip detachably mounted to the head main body portion, the cavitation nozzle hole being formed in the nozzle tip. It is possible to mount an ultrasonic oscillator to the nozzle tip.

Further, the nozzle tip includes a hexahedron defining the cavitation generation hole, thin-plate-like mounting portions extending from two opposing surfaces of the hexahedron except for the surfaces where there are a small-diameter end and a large-diameter end of the cavitation generation hole, and a protruding portion defining a flow passage communicating with the small-diameter end of the cavitation generation hole. A recess of a contour corresponding to the configuration of the nozzle tip is formed in the head main body portion. The nozzle tip can be inserted into the recess and mounted to the head main body portion by the mounting portion. Further, a CCD camera can be suitably provided in the forward end portion of the cleaning head.

BEST MODE FOR CARRYING OUT THE INVENTION

Figure 1:
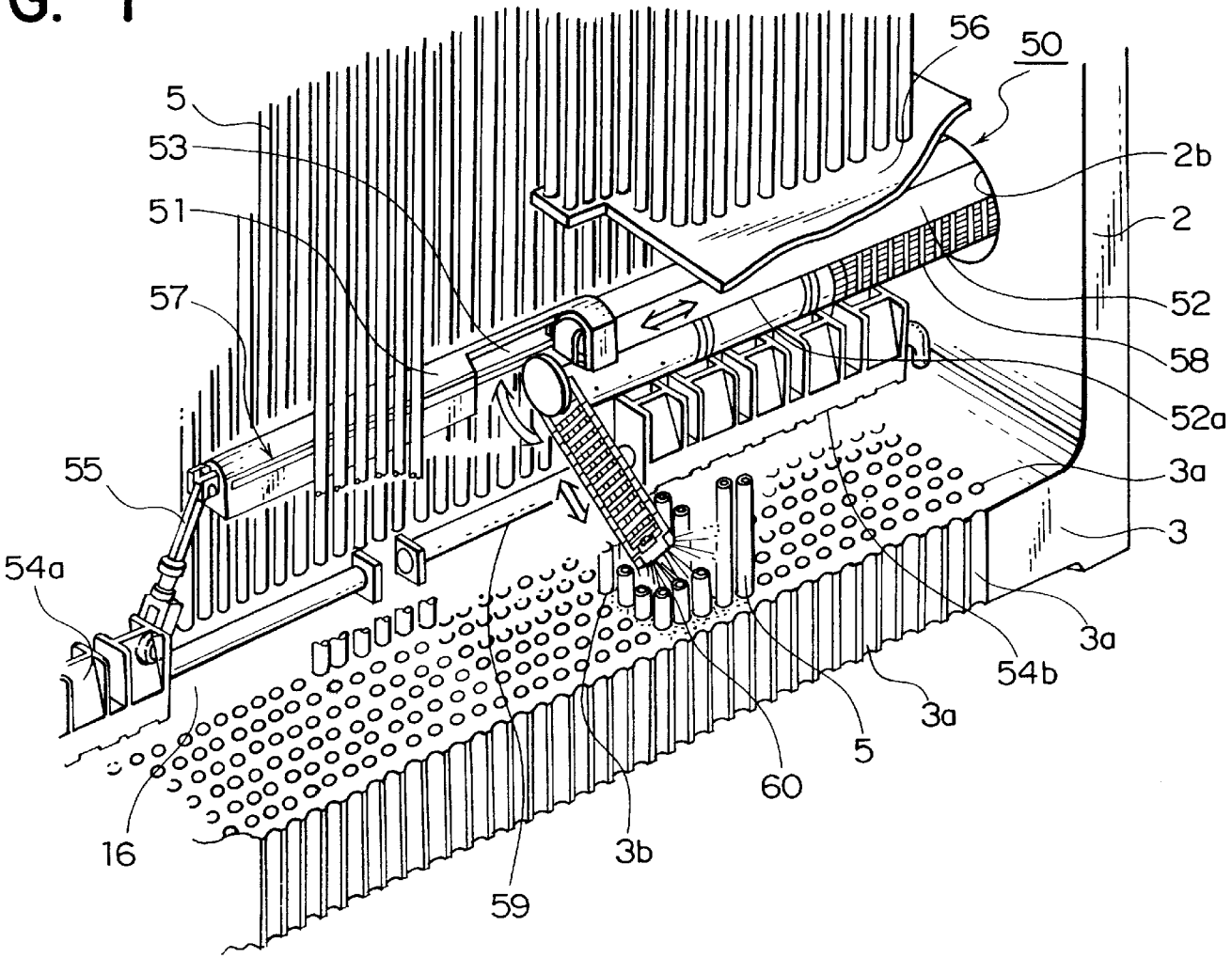
FIG. 1 is a perspective view of a scale removing device according to the present invention for removing scale from the portion centered about the tube plate of a steam generator.

Next, preferred embodiments of the present invention will be described with reference to the accompanying drawings.

In the drawings, the components which are the same as or in correspondence with those of the above-described example are indicated by the same reference numerals. Further, as can be seen from the description below, the present invention is not restricted to this embodiment, but various modifications are possible.

In FIG. 1, shown inside a body portion 2 is a scale removing device 50 for cleaning the portion centered about the tube plate in accordance with the present invention. The tube plate 3 has a large number of holes 3*a*, into which the end portions of the heat-transfer tubes 5 are inserted and secured therein in a watertight manner. Further, in the body portion 2, there are formed, at positions relatively close to the upper surface of the tube plate 3, a pair of diametrically opposed circular hand holes or inspection holes 2*b* (of which only one is shown), and the scale removing device 50 can be inserted into the body portion through these hand holes 2*b*. In this embodiment, a region or portion 3*b* on the upper surface of the tube plate 3, which is shown for convenience as a densely dotted area, represents the adhering scale to be removed.

In FIG. 1, the scale removing device 50 horizontally arranged above the tube plate 3 includes a downwardly open suspension guide device 51 called a monorail, and a cylindrical lance conveying member 52 suspended and supported by the suspension guide device 51 and horizontally guided along the tube lane 16. The suspension guide device 51 has a rail portion 53, and a portion to be guided (not shown) of the lance conveying member 52 engages with the rail portion 53, and is horizontally guided by the rail portion 53. A device for moving the lance conveying member 52 is not shown.

To support the suspension guide device 51 and the lance conveying member 52, one end of the monorail 51 is connected to a length-adjustable support member 55 rotatably mounted to a tube lane block 54*a*. And, the other end (not shown) of the monorail 51 is mounted to a similar support member (not shown) outside the body portion 2. As indicated by numeral 54*b*, the tube lane block is also arranged on the hand hole 2*b* side. Like a flow rate distribution plate 56 shown above the monorail 51, it functions to achieve improvements in flow rate distribution.

The position in the height direction of the monorail 51 with respect to the tube plate 3, and the position thereof in the horizontal direction with respect to the hand hole 2*b*, can be freely controlled by adjusting the amount by which the above-described support member 55, etc. are rotated. Further, on either side of the upper half of the monorail 51, there is longitudinally arranged a support/protection device 57 called an air balloon. This support/protection device 57 consists, for example, of a flexible sack member formed, for example, of rubber. After the positioning of the monorail 51 is performed, air is introduced to thereby expand the sack member, which comes into contact with the tube group on either side of the monorail 51, whereby the monorail 51 is supported in a stable manner and the tube group is protected.

A flexible lance 58 is accommodated in the cylindrical main body 52*a* of the lance conveying member 52. As its name suggests, the flexible lance 58 is flexible. In this embodiment, it is bent substantially at right angles as shown in the drawing. Further, although not shown, a lance driving device is arranged in the cylindrical main body 52*a* to enable the lance 58 to horizontally reciprocate as indicated by the arrows and rotate around the axis of the cylindrical main body 52*a*. Mounted to the forward end of the flexible lance 58 is a cleaning head 60 described below. By moving the lance conveying member 52 by the above-mentioned moving device (not shown), the position of the cleaning head 60 in the X-direction is adjusted. Further, by reciprocating and rotating the lance 58 by the lance driving device, the position of the cleaning head 60 in the Y- and Z-directions is adjusted.

In FIG. 1, numeral 59 indicates a blow down pipe. The blow down pipe 59 is inherently provided in the steam generator, and is arranged separately from a water discharge nozzle (not shown) for eliminating from the tube plate the scale 3*b* removed by the lance. The moving device for the lance conveying member, the lance driving device, the flexible lance, etc. may have a well-known construction, and will not be described in more detail.

The construction of the scale removing device 50 for removing scale from the portion centered about the tube plate is as described above. The present invention is also applicable to devices for removing scale from the portions centered about the tube support plates. An embodiment of the device will now be schematically described with reference to FIGS. 2 and 3.

Figure 2:
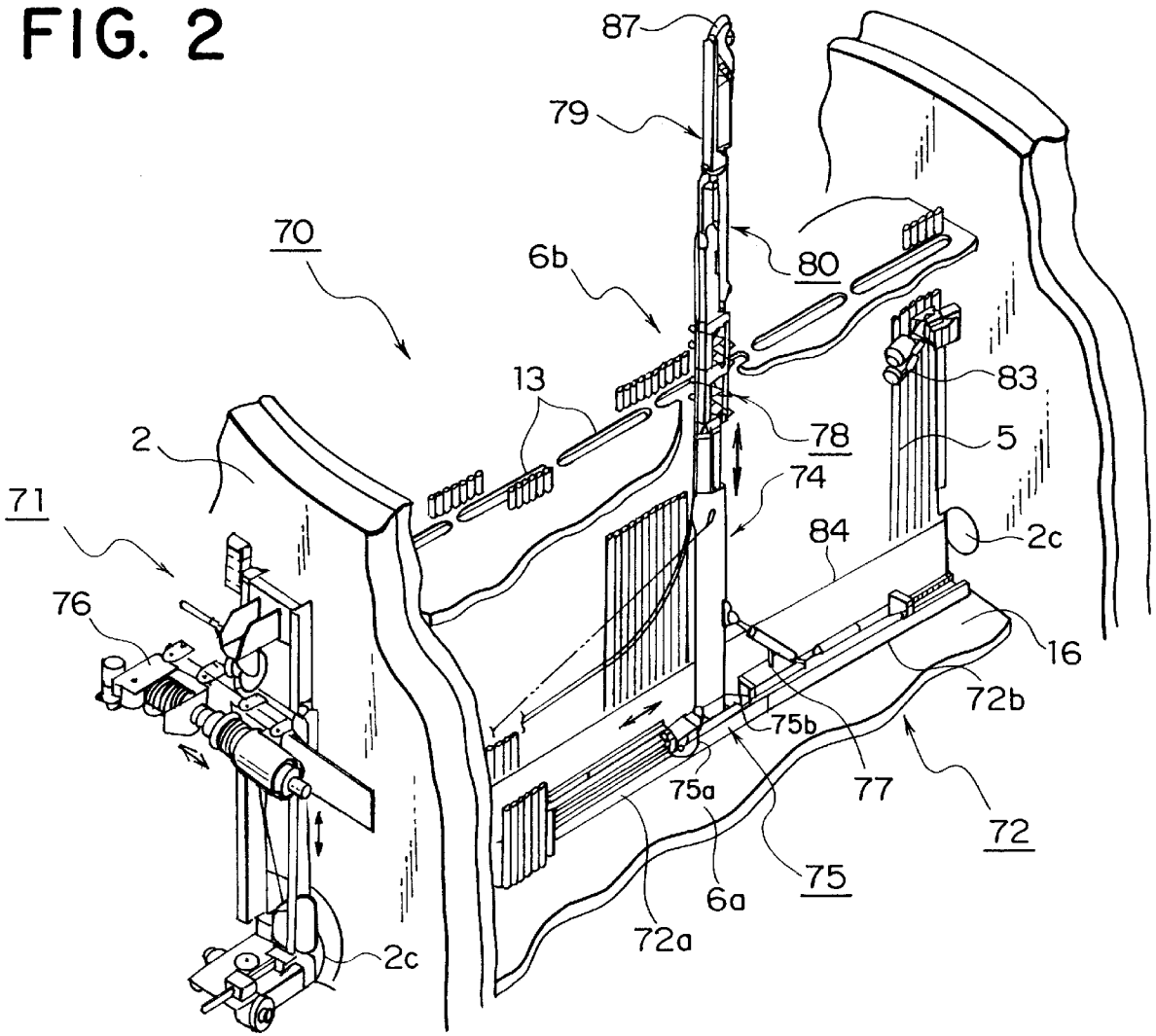
FIG. 2 is a perspective view of a scale removing device according to the present invention for removing scale from the portions centered about the tube support plates of a steam generator.
Figure 3:
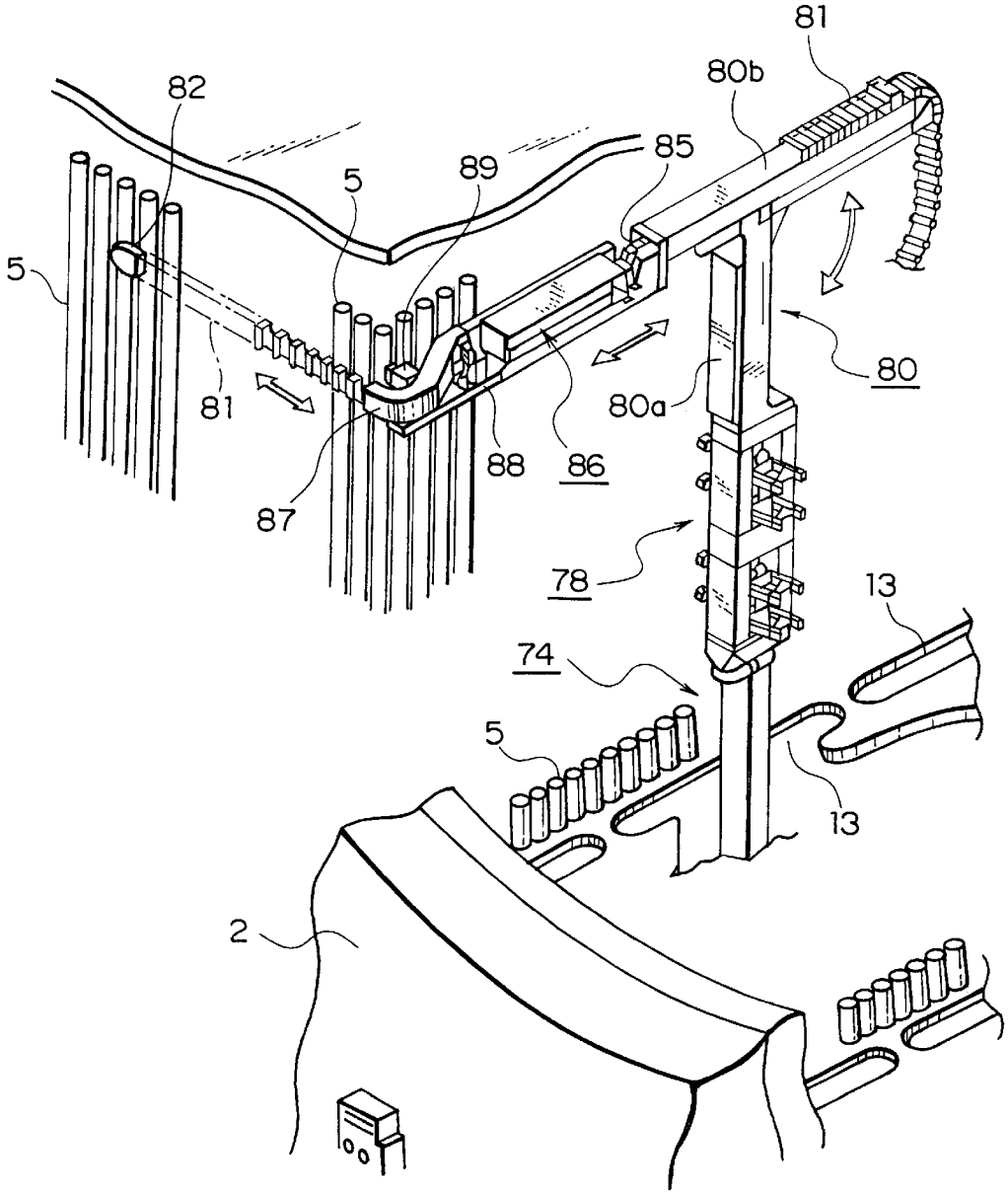
FIG. 3 is an enlarged perspective view of a main portion of the scale removing device of FIG. 2.

FIGS. 2 and 3 show a scale removing device 70 according to another embodiment of the present invention. In this embodiment, an operating device assembly 71 consisting of devices for operating the scale removing device 70 is attached to the outer peripheral surface of the body portion 2. A guide rail assembly 72, which is operationally connected to the operating device assembly 71, is incorporated into the body portion 2. In this embodiment, this guide rail assembly 72 is placed on the first, lowermost tube support plate 6*a*, and, in the vicinity of each end portion of the guide rail assembly 72, there is provided a hand hole 2*c*, which is different from the above-mentioned hand hole 2*b*.

Supported and guided by this guide rail assembly 72 is a movement/connection carriage assembly (movement/connection means) 75 for supporting an ascent/descent device assembly (hereinafter simply referred to as the "ascent/descent device") 74 so as to be capable of movement, erection and inclination. In FIG. 2, the erection/inclination of the ascent/descent device 74 extending vertically upwards is effected by a rigid hydraulic erection/inclination device 77 with the aid of a winch 76, etc. Further, the ascent/descent device 74 includes a tube guide device 78 and an extendable arm assembly 80, and a lance feeding device 79 is mounted to the forward end of the extendable arm assembly 80. A cleaning head 82 provided at the forward end flexible lance 81 is fed to a predetermined position in the tube group by the lance feeding device 79. The cleaning head 82 includes a fluid ejection nozzle described below. By the pressure of the fluid ejected therefrom and impinging upon the scale, the scale is peeled off and removed. The removed scale dropped on the tube support plate is discharged to the exterior of the body portion by some other means.

In FIG. 3, a lance feeding device 86 is mounted to the forward end of an extendable arm portion 85. The lance feeding device 79 includes a lance insertion tube 87 through which the flexible lance 81 passes, and a lance feeding mechanism (not shown), which are attached to a base 88. Further, the lance insertion tube 87 which is capable of rotating by 90 degrees, is provided with a clamp mechanism 89 for supporting the lance insertion tube 87 by a tube group after positioning its forward end between tube rows to be cleaned.

The above-described scale removing device 70, which is in a semi-assembled state when it is outside the body portion of the steam generator, is brought into the body portion and assembled using the following procedures:

1. The operator inserts his hand through the hand hole 2*c*, and mounts a monitoring camera 83 inside the body portion 2;
2. To protect the heat-transfer tubes 5 from damage at the time of assembling the,guide rail assembly, a heat-transfer tube protector 84 is installed in the tube group lane;
3. A separation type guide rail (separated into two portions in the embodiment) 72*a* constituting the guide rail assembly 72 is introduced into the body portion 2 through the hand hole 2*c*. At this time, the movement carriage 75*a* is attached to the guide rail beforehand;
4. After this, with the tube guide mechanism 78, the extendable arm assembly 80, the lance feeding device 79, etc. being connected, the ascent/descent device 74 is inserted in a horizontal position through the hand hole 2*c* to the far end of the movement carriage 75*a;*
5. Next, a connection carriage 75*b* is brought into the body portion by way of the hand hole, and the movement carriage 75*a* and the connection carriage 75*b* are fixed to each other to form a movement/connection carriage assembly 75;
6. Subsequently, the hydraulic erection/inclination device 77 is mounted to the ascent/descent device 74, and then the ascent/descent device 74 is maintained in the erect state as shown in the drawing with the aid of the winch and rack, whereby the preparation for the cleaning of the contaminated portions, in particular the lower sides of the tube support plates, is completed.

To perform cleaning, the rotatable arm portion 80*b* of the extendable arm assembly 80 is rotated to a position where it is perpendicular to the vertical arm portion 80*a*, and the extendable arm portion 85 is extended appropriately. Then, the lance feeding device 86 is operated, and the lance insertion tube 87 is rotated from the face-upward position shown in FIG. 2 to the lateral position shown in FIG. 3 to insert it between heat-transfer tube rows. High-pressure water is ejected as shown in FIG. 3 from the cleaning head 82 inserted to a position to be cleaned, thereby removing the scale at that position.

Next, various embodiments of the scale removing device for the portion centered about the tube plate shown in FIG. 1 and the scale removing device 70 for the portions centered about the tube support plates shown in FIGS. 2 and 3 will be described. To prevent overlap in description, only the former, i.e., the cleaning head 60 of the scale removing device 50 for the portion centered about the tube plate, will be described. However, it is possible to regard the construction of the latter, i.e., the cleaning head 82, to be basically the same as that of the former.

Figures 4A, 4B:
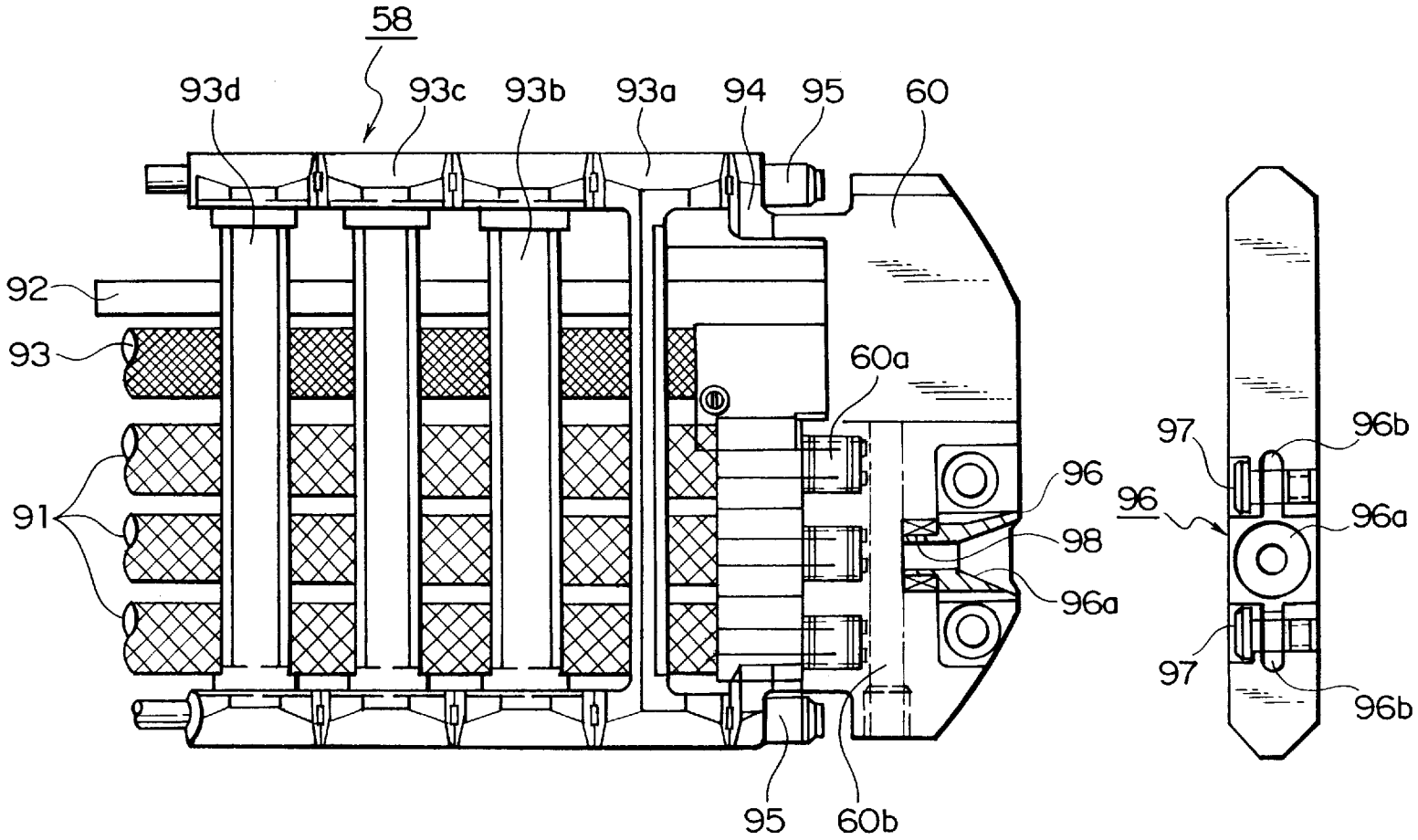
FIG. 4(*a*) is a plan view, partially in section, of a cleaning head of a flexible lance that can be used in the scale removing devices of FIGS. 1 and 2, and FIG. 4(*b*) is a side view thereof.
Figure 5:
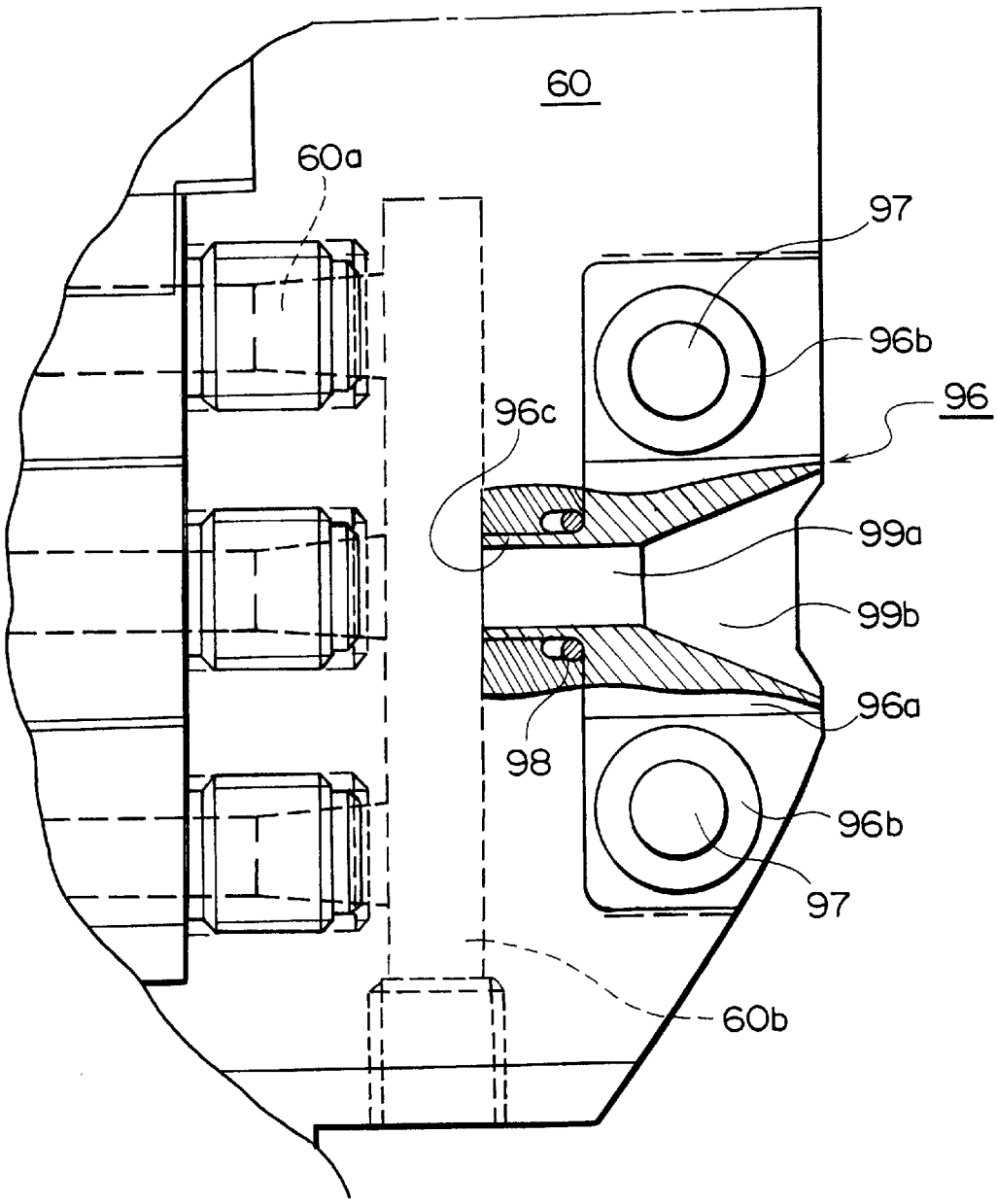
FIG. 5 is a plan view, which is an enlarged view of a part of FIG. 4(*a*), showing the nozzle tip particularly clearly.
Figure 6A:
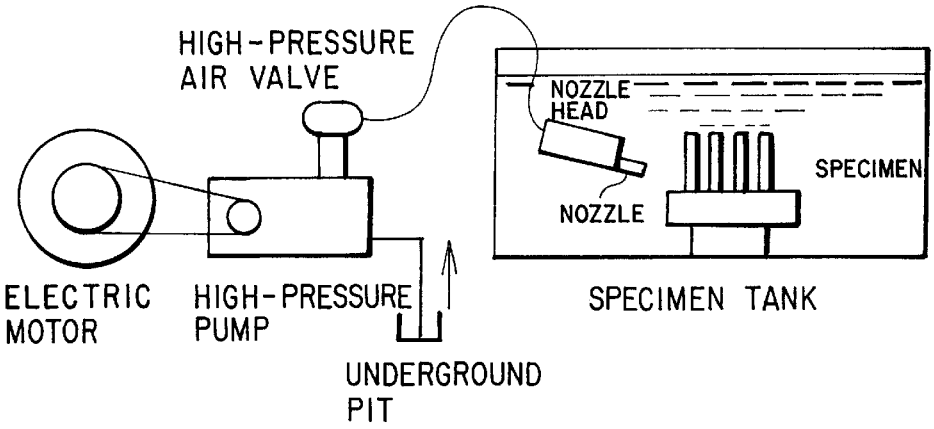
FIGS. 6(*a*), 6(*b*), and 6(*c*) are diagrams schematically showing a test apparatus using a cleaning head according to the present invention, and FIG. 6(*d*) is an explanatory diagram showing the propagation of impact pressure when cleaning is performed by using the cleaning head shown in FIG. 6(*c*)
Figure 6B:
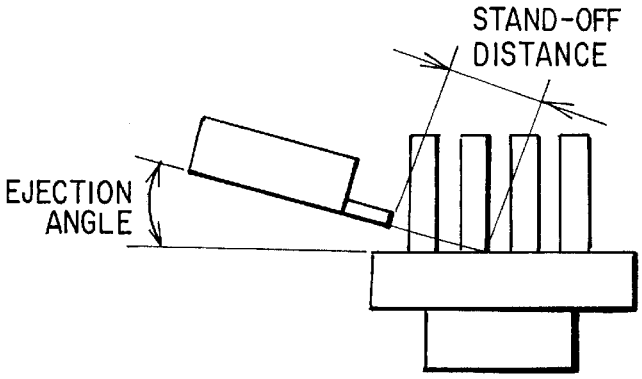
Figure 6C:
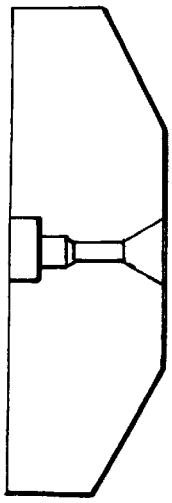
Figure 6D:
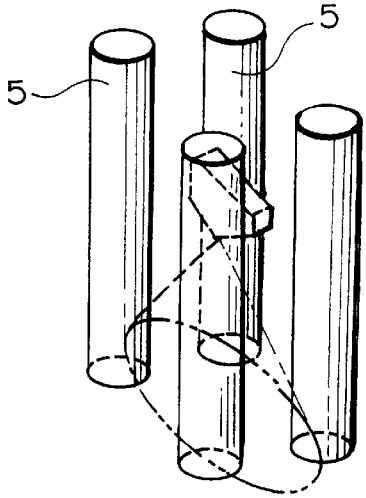
Figure 10:
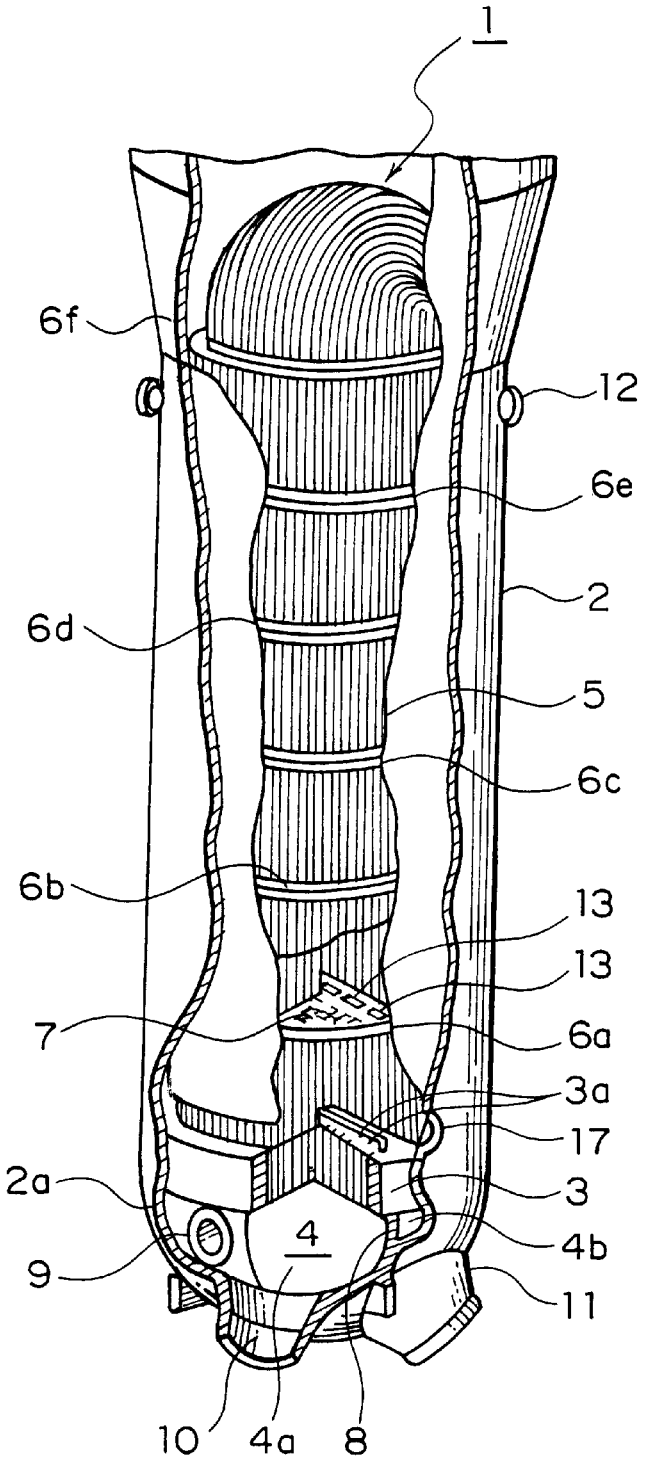
FIG. 10 is a partially cutaway elevation view of a body portion of a conventional steam generator which is provided to aid the understanding of the present invention.
Figure 11:
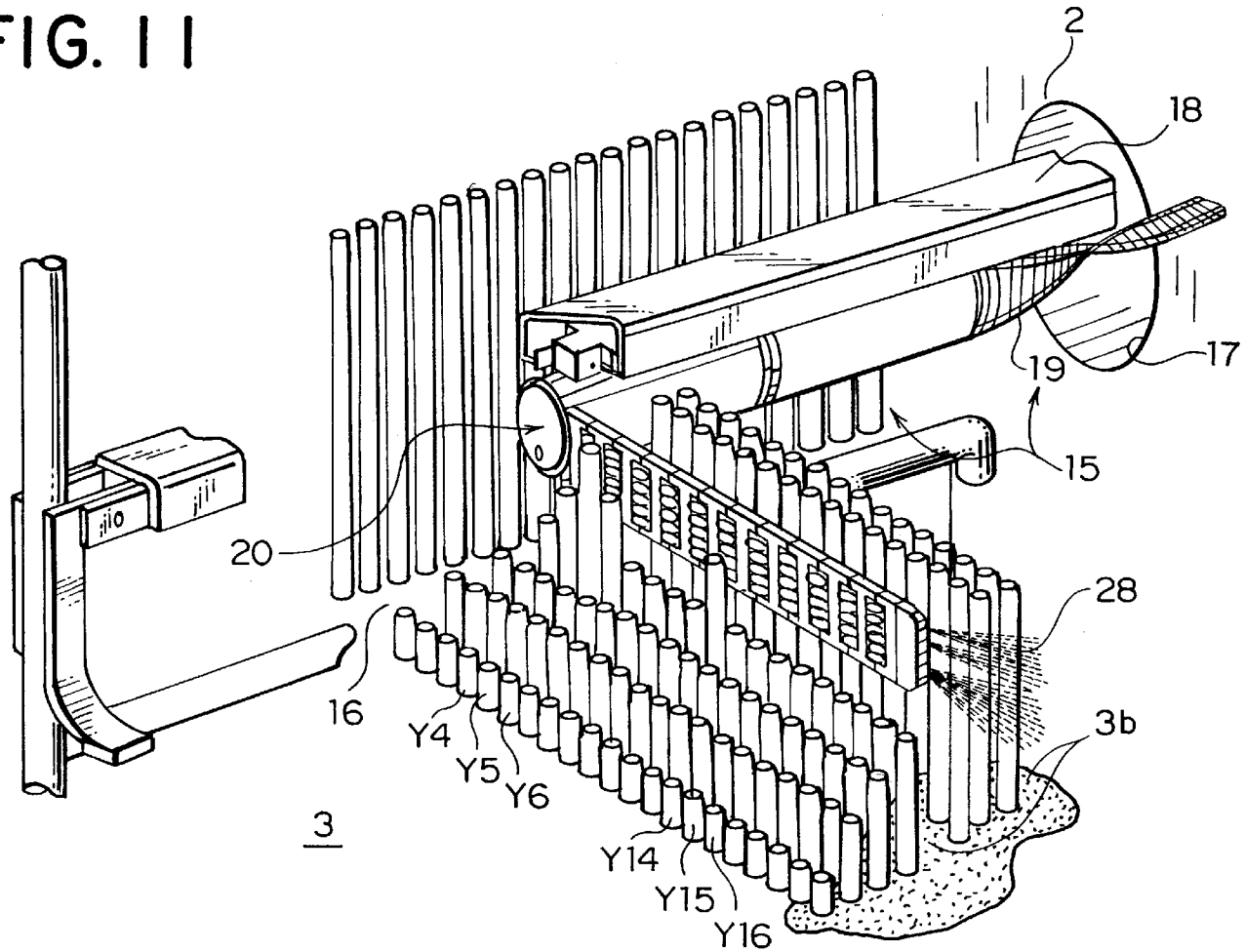
FIG. 11 is a perspective view of a conventional device for removing scales from the portion centered about the tube plate.
Figure 12:
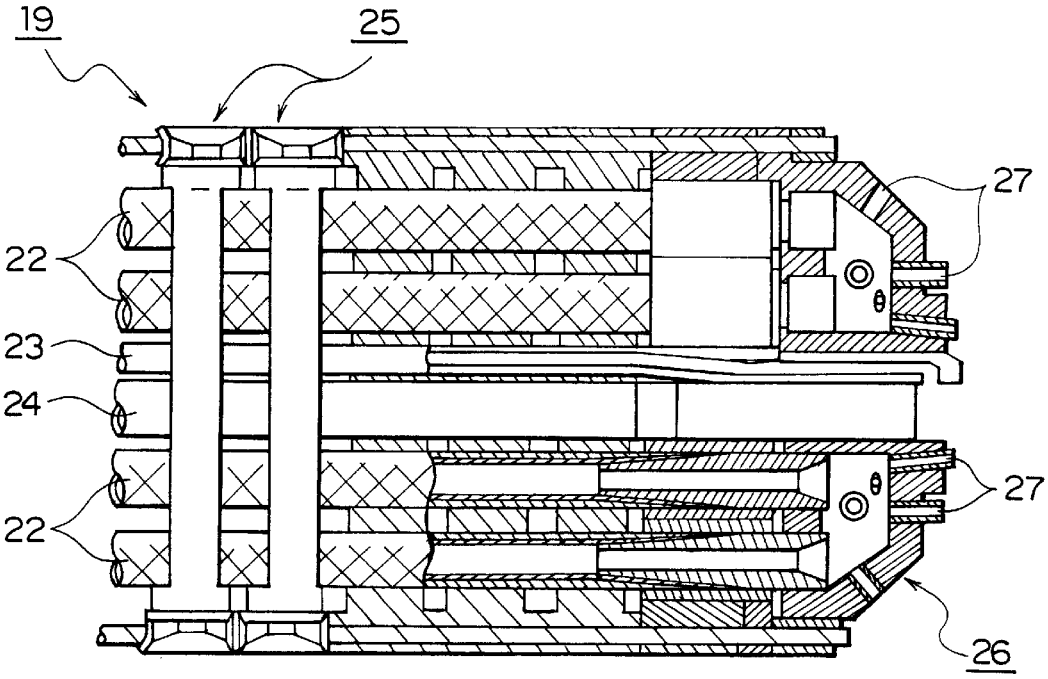
FIG. 12 is a sectional view showing a cleaning head at the forward end of a flexible lance used in the scale removing device of FIG. 11.
Figure 13:
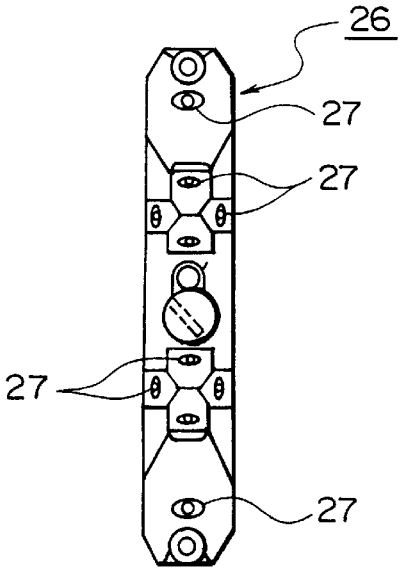
FIG. 13 is a side view of the cleaning head of FIG. 12.
Figure 14:
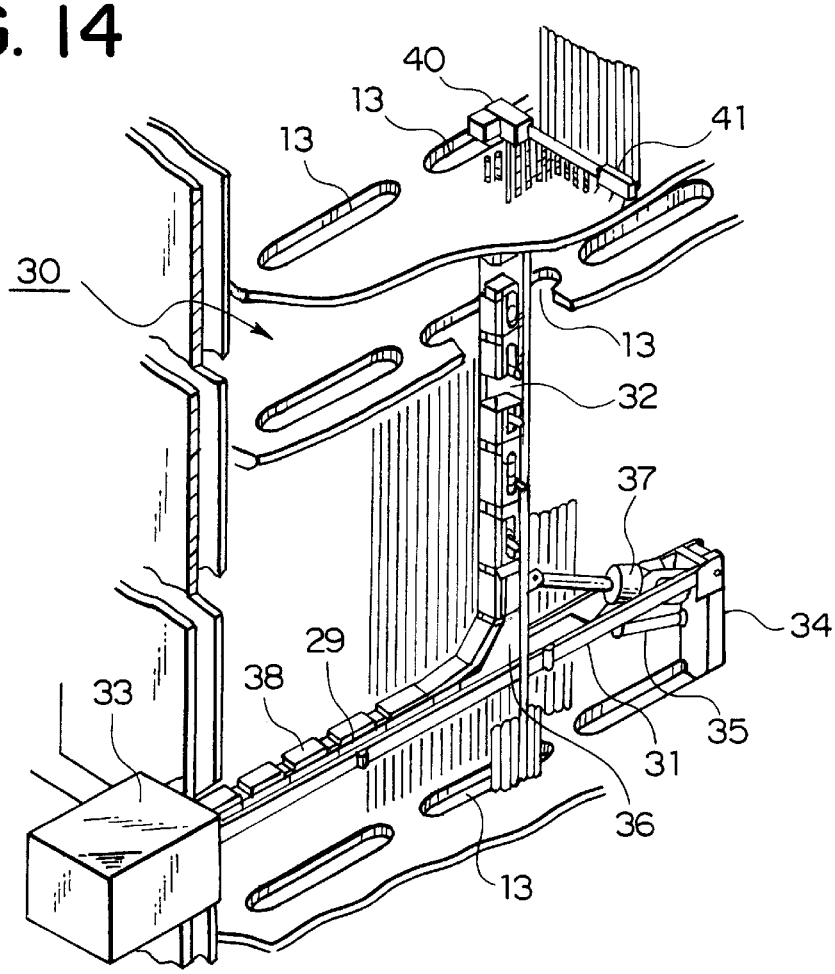
FIG. 14 is a perspective view of a conventional device for removing scales from the portions centered about the tube support plates.
Figure 15:
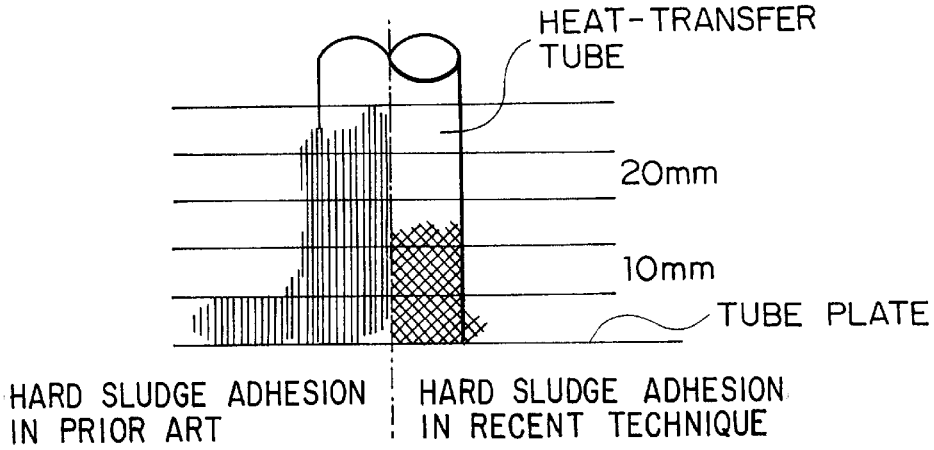
FIG. 15 is a diagram illustrating scale removal using a conventional water jet.
Figure 16A:
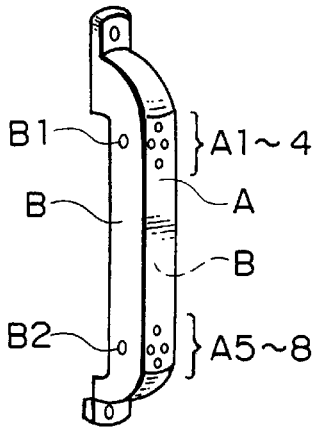
FIG. 16(*a*) is a partial view of a conventional cleaning head used in an experiment, FIG. 16(*b*) is a plan view showing water jets ejected between heat-transfer tubes from the nozzle holes of the cleaning head, FIG. 16(*c*) is a plan view showing regions of the tube plate that can be cleaned by the water jets as well as regions out of the ejection paths, and FIG. 16(*d*) is an elevation view showing regions of the heat-transfer tube that can be cleaned by water jets as well as regions out of the ejection paths.
Figure 16B:
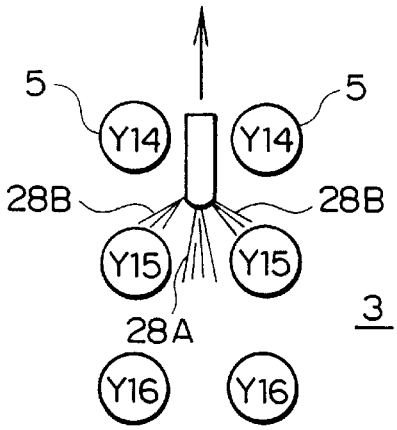
Figure 16C:
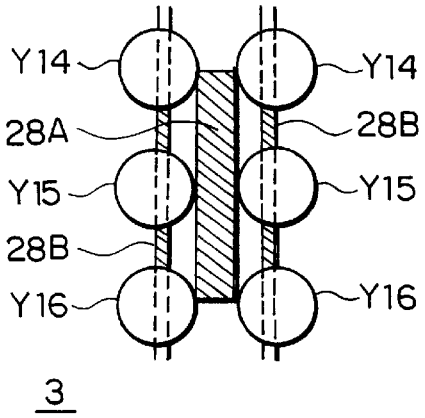
Figure 16D:
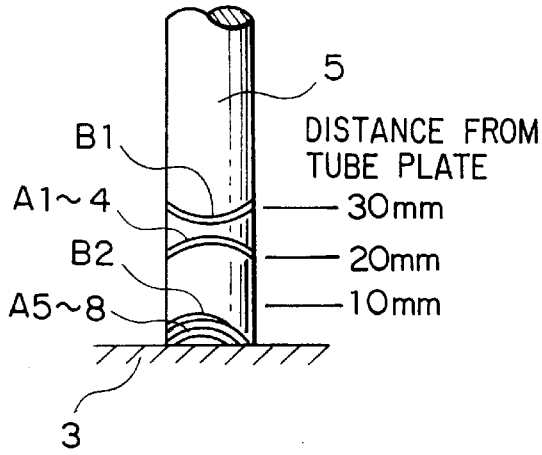

FIGS. 4 and 5 show the forward end portion of the lance 58 and the cleaning head 60 mounted thereto. It is possible for the lance 58 to have an ordinary construction as shown, for example, in FIG. 10. To describe it briefly, in this embodiment, it includes three high-pressure water hoses 91, one nitrogen purge line 92, and one video probe optical fiber cable 93. These hoses, etc. are mutually fixed by integral blocks 93*a*, 93*b*, 93*c*, . . . arranged longitudinally. And, to a mounting end portion block 94 in the foremost block 93*a*, the thin cleaning head 60 is mounted by an appropriate fastening means 95.

The cleaning head 60 has socket portions 60*a* for receiving the high-pressure water hoses 91, and the socket portions 60*a* communicate with a single chamber 60*b*. And, a nozzle tip 96 is detachably mounted in a liquid-tight fashion so as to communicate with the chamber 60*b*. The nozzle tip 96 has a cube-like main body portion (hexahedron) 96*a*, flange-like mounting portions 96*b* extending from the upper and lower surfaces of the main body portion 96*a*, and a cylindrical communication portion (protruding portion) 96*c* protruding from the inner surface of the main body portion 96*a* toward the chamber 60*b*.

As can be seen from FIGS. 4 and 5, the cleaning head 60 has a recess of a configuration suitable for receiving the above-mentioned nozzle tip 96. The nozzle tip 96 is reliably secured to the cleaning head 60 by means of two fastening screws 97 in the mounting portions 96*b* and communicates with the chamber 60*b* through the communication portion 96*c*. Around the communication portion 96*c*, there is arranged a sealing means such as an O-ring 98 so that the nozzle tip 96 can be mounted to the cleaning head 60 in a liquid-tight fashion. Formed in the communication portion 96*c* is a flow passage 99*a* of substantially the same diameter, and, formed in the main body portion 96*a* is a cone-shaped nozzle hole 99*b*. One end of the flow passage 99*a* communicates with the chamber 60*b*, and the other end thereof communicates with the small-diameter end of the nozzle hole 99*b*. The large-diameter end of the nozzle hole 99*b* is exposed to the exterior.

When using the cleaning head 60 for the purpose of removing scales, water is poured over the tube plate until at least the entire cleaning head 60 is immersed in water, and then high-pressure water is supplied to the high-pressure water hose 91. The high-pressure water passing through the high-pressure water hose 91 enters the chamber 60*b* of the immersed cleaning head 60, from which it passes through the flow passage 99*a* of the nozzle tip 96 as a water jet before it is ejected through the nozzle hole 99*b*. When a water jet is ejected through the nozzle hole 99*b* of the configuration shown, the liquid around this water jet is accelerated, the pressure is locally reduced to become less than steam pressure, and the liquid is evaporated to become bubbles, which grow. This phenomenon is called cavitation. When the cavitation bubbles collapse, a very high impact pressure is generated.

Thus, when the cavitation bubbles are applied to firmly adhering scale, the bubbles collapse to generate high impact pressure, which is capable of peeling off even hard scale. The cavitation jet is characterized in that it makes it possible to obtain high impact pressure over a wide range with a pressure lower than that of high-pressure water. Further, the bubbles are scattered to generate impact pressure over a wide range, so that they also reach areas which cannot be reached by the conventional water jet. Thus, it is possible to suitably clean even those regions out of the ejection paths. Further, since high impact pressure is obtained over a wide range, the construction of the device for operating the lance with the cleaning head is simplified, thus enabling the system to be easily formed as a robot.

By using the test apparatus shown in FIGS. 6(*a*) and 6(*b*), a scale removal test was conducted with the cleaning head or nozzle head of FIG. 6(*c*) having a nozzle configuration substantially the same as that of the cleaning head shown in FIGS. 4 and 5. As shown in FIG. 6(*d*), cavitation bubbles were moved (propagated) to widen the area that can be cleaned, so that, by appropriately setting the factors, such as ejection angle, nozzle pressure, flow rate, stand-off distance, and tube plate surface depth, not less than 80% of the cavitation action surface for the specimens (heat-transfer tubes) reaches an impact pressure effective in scale removal, without generating any erosion beyond the allowable value of surface roughness (ejection time: 60 minutes). Further, under the assumption that it was being applied to an actual steam generator tube plate, the ejection angle was set to 58 degrees. In this case, effective cavitation acted over a range of 10 mm or more in the height direction from the tube plate, and over substantially half the periphery in the circumferential direction. Thus, it was ascertained that it was effective for the regions to be cleaned including the regions which would be out of the ejection path if an existing scale removing device were used.

Figure 7:
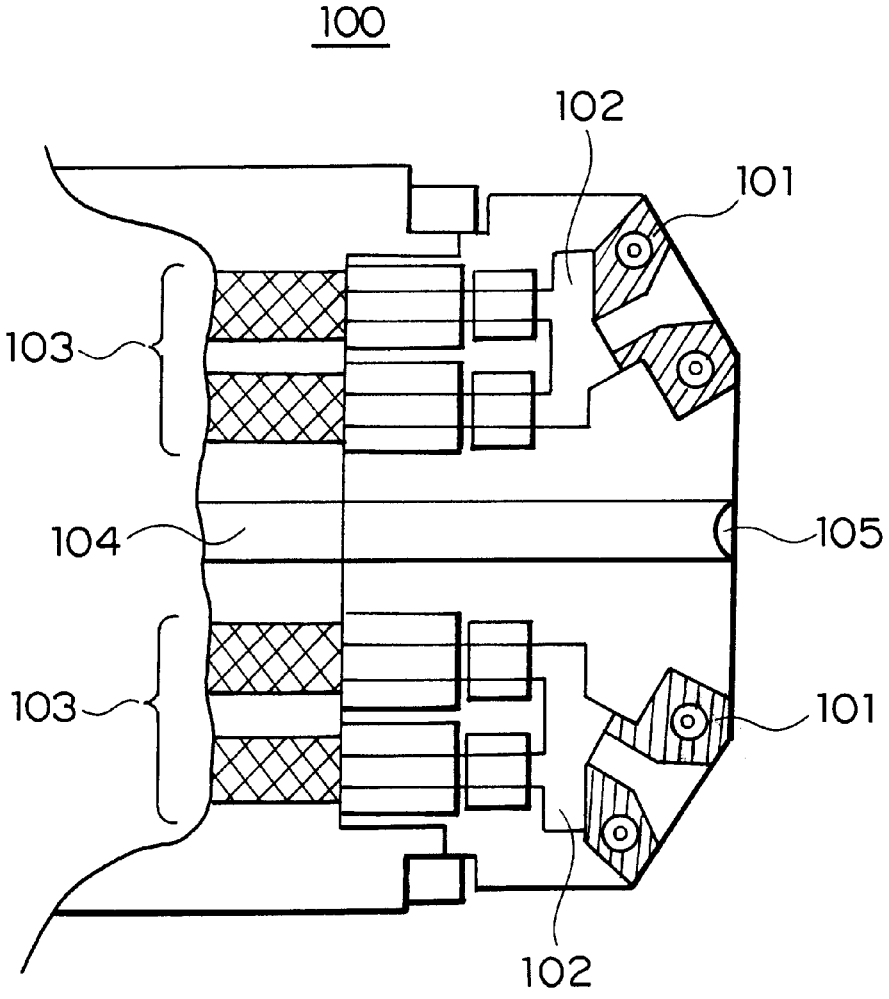
FIG. 7 is a sectional view showing a modification of the cleaning head of the present invention.

The present invention is not restricted to the preferred embodiment described above, but various modifications are possible. For example, as shown in FIG. 7, it is possible to adopt a cleaning head 100 having two cavitation nozzle tips 101. In FIG. 7, chambers 102 communicating with the nozzle tips are formed in the cleaning head 100. High-pressure water is supplied to the nozzle tips 101 through the chamber 102 to generate cavitation as described above. Numeral 104 indicates an image guide consisting, for example, of an optical fiber connected to a CCD camera 105 at the forward end of the head.

Figure 8:
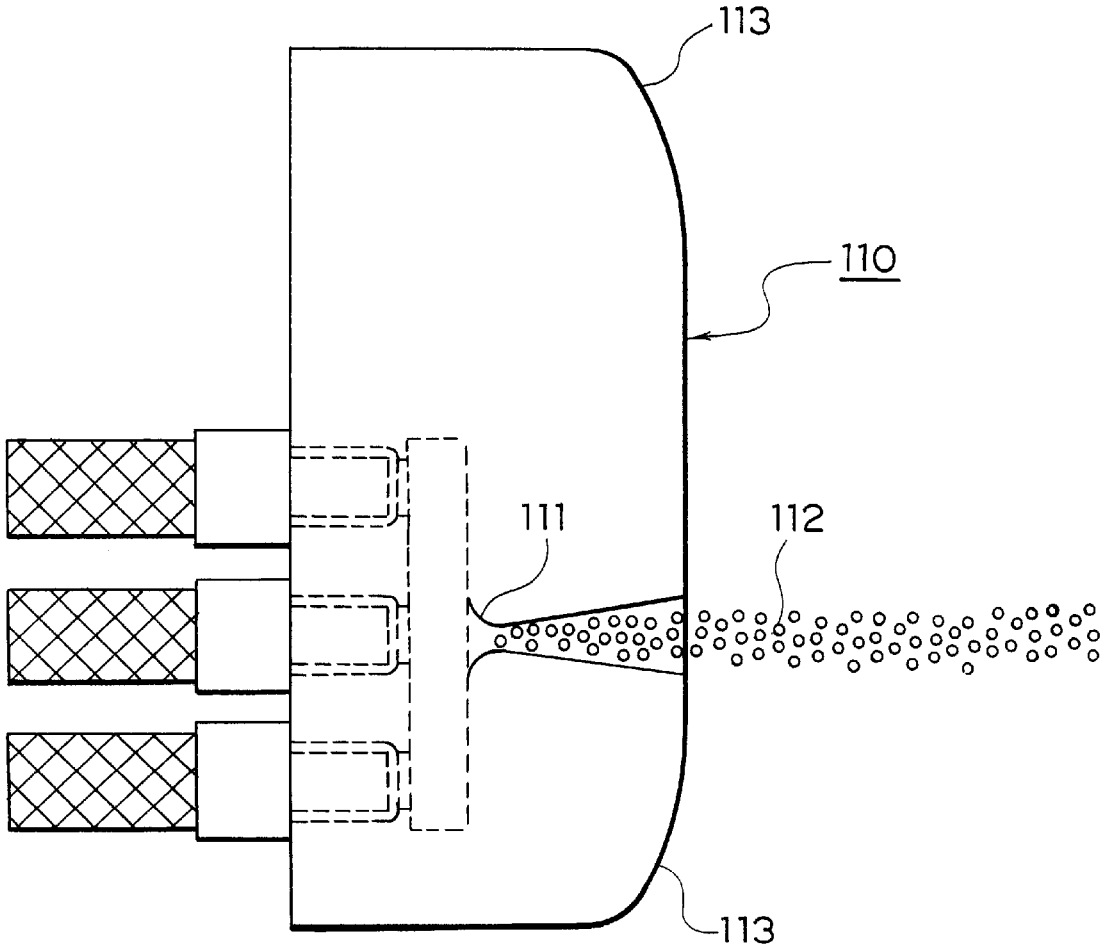
FIG. 8 is a sectional view showing another modification of the cleaning head of the present invention.
Figure 9A:
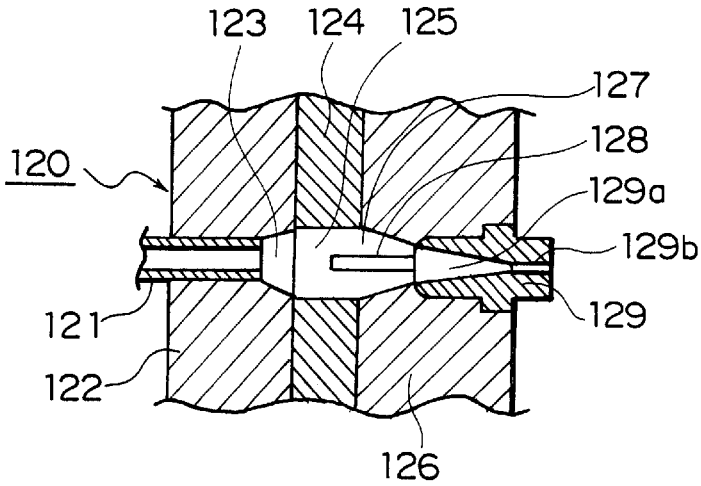
FIGS. 9(*a*) through 9(*d*) are sectional views showing various nozzle assemblies or nozzle tips that can be used in the cleaning head of the present invention.
Figure 9B:
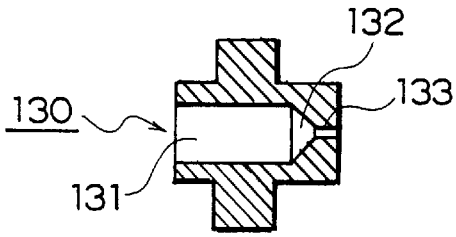
Figure 9C:
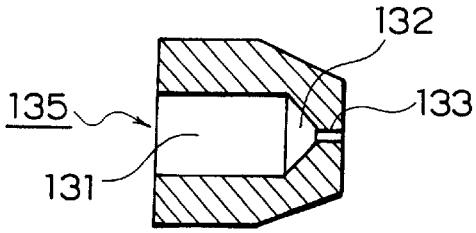
Figure 9D:
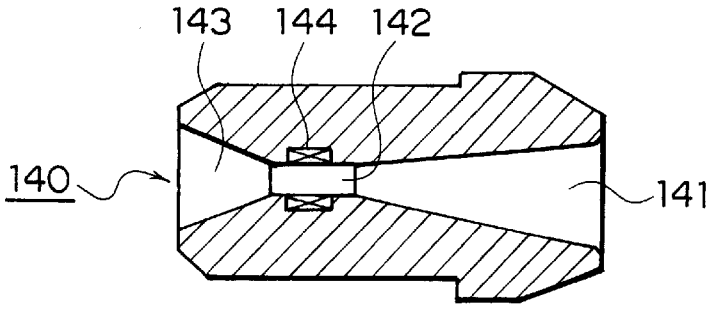

In a venturi-type cleaning head 110 shown in FIG. 8, the portion corresponding to the cylindrical flow passage 99*a* of FIGS. 4 and 5 is formed as a throat portion 111, so that the cavitation, shown by bubbles 112, is generated in the throat portion 111. Thus, this cleaning head 110 can be used not only in water, but also in the air. Further, in this cleaning head 110, the front edges are not simply obliquely chamfered, but formed as curved portions 113.

As can be easily seen from FIG. 1, the lance 58 can move along the cylindrical main body 52*a* of the lance conveying member 52 as indicated by the white arrows, so that, when it is completely drawn back, the cleaning head at the forward end thereof is positioned on the inner side of an end cover member of the cylindrical main body. In this condition, the scale removing device 50 is brought in and taken out of the body portion through the hand hole 2*b*. Thus, when the corners of the cleaning head 110 are formed as curved portions 113 as shown in FIG. 8, there is no interference with the hand hole 2*b* when the device is brought in and taken out of the body portion, thereby achieving an improvement in terms of operational efficiency. Thus, the curved portions 113 are best adapted to the outer peripheral configuration of the end cover member of the cylindrical main body 52*a* shown in FIG. 1.

Next, with reference to FIGS. 9(*a*) through 9(*d*), various cleaning heads or nozzle tips which can be applied to the scale removing device of the present invention to generate cavitation will be described. A cleaning head 120 shown in FIG. 9(*a*) includes a first member 122 having a cone-shaped flow passage 123 communicating with a high-pressure water hose 121, a second member 124 having a cylindrical flow passage 125 communicating with the flow passage 123, and a third member 126 having a cone-shaped flow passage 127 communicating with the flow passage 125. Detachably fitted into the third member 126 is a nozzle tip 129 containing a cone-shaped flow passage 129*a* communicating with the flow passage 127 and a cylindrical flow passage 129*b*. Further, arranged in the cone-shaped flow passage 127 is a cylindrical member or pin 128 whose forward end protrudes into the cylindrical flow passage 125. In this cleaning head 120, high-pressure water enters the cone-shaped flow passage 123 from the high-pressure hose 121, and is ejected into the cylindrical flow passage 125 to generate cavitation around the pin 128. In this cleaning head 120,the nozzle tip 129, etc. are further provided in front of the flow passage 125, so that, if the cleaning head 120 is used in the air, it is possible to generate cavitation.

FIGS. 9(*b*) and 9(*c*) show other nozzle tips 130 and 135 which are of an orifice type. In front of a cylindrical flow passage or chamber 131, there is provided a tapered, substantially cone-shaped flow passage 132, and, at the forward end of the cone-shaped flow passage 132, there is formed a relatively short cone-shaped flow passage 133. It is assumed that, by reducing the length of this flow passage 133, the generation of cavitation in the high-pressure water flowing from the left to the right in the drawing is promoted. The nozzle tips 130 and 135 are different in outer configuration.

FIG. 9(*d*) shows a horn-type nozzle tip 140. High-pressure water is introduced into a horn-shaped flow passage 141 from the right side of a nozzle tip 140, and it flows by way of a cylindrical chamber or flow passage 142 before it leaves a cone-shaped flow passage 143 to generate cavitation. In this embodiment, the generation of cavitation is promoted by mounting an appropriate ultrasonic oscillator 144 to the cylindrical flow passage 142.

Apart from the above-described preferred embodiments and modifications thereof of the present invention, the following modifications are possible:

(1) The ultrasonic oscillator, which is only used in the modification shown in FIG. 9(*d*), can be provided on the upstream side of the nozzle (a position where cavitation is not generated yet) when promotion of cavitation is desired.

(2) While in the above embodiments one or two nozzle tips are used, it is possible to increase the number of nozzle tips. Further, when mounting a plurality of nozzle tips to the same cleaning head, a combination of different types of nozzle tips is possible.

(3) A CCD camera and an image guide can also be provided in the cleaning heads of the embodiments in which they are not incorporated.

Industrial Applicability

As described above, there is provided, in accordance with the present invention, a scale removing device for a steam generator of the type which includes a body portion, a tube plate and a plurality of tube support plates arranged horizontally in the body portion so as to traverse the body portion. A plurality of heat-transfer tubes extend from the tube plate and end at the tube plate and extend through the tube support plates in a row-like fashion so as to define a tube lane in the body portion. A hand hole is formed at a position above the tube plate through which the scale removing device is inserted to clean a portion centered about the tube plate. The scale removing device comprises a flexible lance holding a high-pressure water hose movable with respect to the tube plate and the heat-transfer tubes and a cleaning head mounted to the forward end of the flexible lance. Formed inside the cleaning head are a fluid passage communicating with the high-pressure water hose, a chamber communicating with the fluid passage, and a cavitation generating nozzle hole communicating with the chamber. When high-pressure water is caused to flow through the flexible lance, cavitation is generated, and an intense impact pressure is propagated from the nozzle hole of the cleaning head over a wide range and hits the scale in the portion centered about the tube plate, thereby making it possible to easily remove scale which otherwise toughly adheres to a region out of the ejection path. This is particularly advantageous when this steam generator is used in a nuclear power plant, since it helps to protect the operators from exposure to radiation and to maintain the heat-transfer tubes in a sound state.

Further, in accordance with the present invention, the scale removing device preferably further comprises a suspension guide device horizontally arranged on the tube plate and a lance conveying member suspended by the suspension guide device and guided in horizontal movement through the hand hole. The flexible lance runs through the lance conveying member and is paid out from and drawn back to the lance conveying member. The forward end portion of the cleaning head is formed into a curved surface not interfering with the body portion wall surface defining the hand hole, whereby there is advantageously no interference with the hand hole when the scale removing device, in which the flexible lance with the cleaning head is accommodated in the lance conveying member, is brought in and taken out through the hand hole. Further, when the cleaning head is inserted between a number of closely arranged heat-transfer tubes in the steam generator, the insertion is facilitated when the forward end portion of the cleaning head is formed as a curved surface.

Further, the same effect can be obtained when the lance conveying member has a cylindrical main body through which the flexible lance runs and when the forward end portion of the cleaning head is configured such that when the flexible lance has been completely drawn back, it does not protrude from the peripheral surface of the cylindrical main body. The number of cavitation generating nozzle holes may be one or two.

Furthermore, in accordance with the present invention, there is provided a scale removing device for a steam generator including a body portion, a plurality of tube support plates horizontally arranged inside the body portion so as to traverse the body portion, a plurality of heat-transfer tubes extending in a row-like fashion through the tube support plates so as to define a tube lane in the body portion, a pair of hand holes formed in the body portion at a position directly above at least one of the tube support plates so as to be diametrically opposed to each other and flow slots formed in the portions of the tube support plates corresponding to the tube lane. The scale removing device is inserted through the hand holes, ascending and descending through the flow slots formed in the tube support plates, and cleaning the portions centered about the tube support plates. The scale removing device comprises a flexible lance holding a high-pressure water hose movable with respect to the tube support plates and the heat-transfer tubes. A cleaning head is mounted to the forward end of the flexible lance. Formed inside the cleaning head are a fluid passage communicating with the high-pressure water hose, a chamber communicating with the fluid passage, and a cavitation generating nozzle hole communicating with the chamber. When high-pressure water is caused to flow through the flexible lance, cavitation is generated, and an intense impact pressure is propagated from the nozzle hole of the cleaning head over a wide range and hits the scale in the portion centered about the tube plate, thereby making it possible to easily remove toughly adhering scale. This is particularly advantageous when this steam generator is used in a nuclear power plant, since it helps to protect the operators from exposure to radiation and to maintain the heat-transfer tubes in a sound state.

Further, the cleaning head includes a head main body portion in which the fluid passage and the chamber communicating with the fluid passage are formed. A nozzle tip is detachably mounted to the head main body portion. The cavitation nozzle hole is formed in the nozzle tip, whereby, if erosion is generated in the nozzle tip as a result of repeated use, it is possible to easily replace the nozzle tip with a new one, thereby achieving a reduction in maintenance cost.

Further, in accordance with the present invention, it is possible to mount an ultrasonic oscillator to the nozzle tip, whereby it is possible to further enhance the cavitation impact pressure, thereby increasing the ratio at which the adhering scales are removed.

Further, the nozzle tip includes a hexahedron defining the cavitation generation hole, thin-plate-like mounting portions extending from two opposing surfaces of the hexahedron except for the surfaces where there are a small-diameter end and a large-diameter end of the cavitation generation hole. A protruding portion defines a flow passage communicating with the small-diameter end of the cavitation generating hole, wherein a recess of a contour corresponding to the configuration of the nozzle tip is formed in the head main body portion. The nozzle tip can be inserted into the recess and mounted to the head main body portion by the mounting portion, whereby it is possible to reduce the size of the nozzle tip, making the scale removing device suitable for insertion between closely arranged heat-transfer tubes as in the case of a steam generator. Further, by providing a CCD camera in the forward end portion of the cleaning head, it is possible to perform the cleaning operation while observing an image of the portion being cleaned that is displayed on a monitor outside the steam generator.

What is claimed is:

1. A scale removing device for a steam generator of the type which includes:

a body portion;

a tube plate and a plurality of tube support plates arranged horizontally in the body portion so as to traverse the body portion;

a plurality of heat-transfer tubes which extend from the tube plate and end at the tube plate and which extend through the tube support plates so as to define a tube lane in the body portion; and a hand hole which is formed at a position above the tube plate and through which the scale removing device is inserted to clean a portion centered about the tube plate, the scale removing device comprising:

a flexible lance holding a high-pressure water hose and movable with respect to the tube plate and the heat-transfer tubes; and a cleaning head mounted to the forward end of the flexible lance, wherein formed inside the cleaning head are a fluid passage communicating with the high-pressure water hose, a chamber communicating with the fluid passage, and a cavitation generating nozzle hole communicating with the chamber;

wherein the cleaning head includes a head main body portion in which the fluid passage and the chamber communicating with the fluid passage are formed, and a nozzle tip detachably mounted to the head main body portion, the cavitation generating nozzle hole being formed in the nozzle tip.

2. A scale removing device for a steam generator according to claim 1, wherein an ultrasonic oscillator is mounted to the nozzle tip.

3. A scale removing device for a steam generator according to claim 1, wherein the nozzle tip includes a hexahedron defining the cavitation generating hole, thin-plate-like mounting portions extending from two opposing surfaces of the hexahedron except for the surfaces where there are a small-diameter end and a large-diameter end of the cavitation generating hole, and a protruding portion defining a flow passage communicating with the small-diameter end of the cavitation generating hole, wherein a recess of a contour corresponding to the configuration of the nozzle tip is formed in the head main body portion, and wherein the nozzle tip can be inserted into the recess and mounted to the head main body portion by the mounting portion.

4. A scale removing device for a steam generator according to claim 1, wherein a CCD camera is provided in the forward end portion of the cleaning head.

5. A scale removing method, wherein a water jet is ejected toward an object to be cleaned that is submerged in water to accelerate the liquid around the water jet to thereby locally generate a pressure not higher than steam pressure to thereby generate bubbles as a result of evaporation of the liquid to cause cavitation, thereby cleaning the object to be cleaned.

6. A scale removing device for a steam generator including:

a body portion;

a plurality of tube support plates horizontally arranged inside the body portion so as to traverse the body portion;

a plurality of heat-transfer tubes extending through the tube support plates so as to define a tube lane in the body portion;

a pair of hand holes formed in the body portion at a position directly above at least one of the tube support plates so as to be diametrically opposed to each other; and flow slots formed in the portions of the tube support plates corresponding to the tube lane, the scale removing device being inserted through the hand holes, ascending and descending through the flow slots formed in the tube support plates, and cleaning the portions centered about the tube support plates;

wherein the scale removing device comprises:

a flexible lance holding a high-pressure water hose and movable with respect to the tube support plates and the heat-transfer tubes; and a cleaning head mounted to the forward end of the flexible lance;

wherein formed inside the cleaning head are a fluid passage communicating with the high-pressure water hose, a chamber communicating with the fluid passage, and a cavitation generating nozzle hole communicating with the chamber;

wherein the cleaning head includes a head main body portion in which the fluid passage and the chamber communicating with the fluid passage are formed, and a nozzle tip detachably mounted to the head main body portion, the cavitation generating nozzle hole being formed in the nozzle tip.

7. A scale removing device for a steam generator according to claim 6, wherein an ultrasonic oscillator is mounted to the nozzle tip.

8. A scale removing device for a steam generator according to claim 6, wherein the nozzle tip includes a hexahedron defining the cavitation generating hole, thin-plate-like mounting portions extending from two opposing surfaces of the hexahedron except for the surfaces where there are a small-diameter end and a large-diameter end of the cavitation generating hole, and a protruding portion defining a flow passage communicating with the small-diameter end of the cavitation generating hole, wherein a recess of a contour corresponding to the configuration of the nozzle tip is formed in the head main body portion, and wherein the nozzle tip can be inserted into the recess and mounted to the head main body portion by the mounting portion.

9. A scale removing device for a steam generator according to claim 6, wherein a CCD camera is provided in the forward end portion of the cleaning head.

10. A scale removing device for a steam generator of the type which includes:

a body portion;

a tube plate and a plurality of tube support plates arranged horizontally in the body portion so as to traverse the body portion;

a plurality of heat-transfer tubes which extend from the tube plate and end at the tube plate and which extend through the tube support plates so as to define a tube lane in the body portion; and a hand hole which is formed at a position above the tube plate and through which the scale removing device is inserted to clean a portion centered about the tube plate, the scale removing device comprising:

a flexible lance holding high-pressure water hoses and movable with respect to the tube plate and the heat-transfer tubes; and a cleaning head mounted to the forward end of the flexible lance, wherein formed inside the cleaning head are fluid passages communicating with the high-pressure water hoses, chambers communicating with the fluid passages, and a plurality of cavitation generating nozzle holes communicating with the chambers;

wherein the cleaning head includes a head main body portion in which the fluid passages and the chambers communicating with the fluid passages are formed, and nozzle tips detachably mounted to the head main body portion, the cavitation generating nozzle holes being formed in the nozzle tips.

11. A scale removing device for a steam generator according to claim 10 wherein an ultrasonic oscillator is mounted to the nozzle tips.

12. A scale removing device for a steam generator according to claim 10, wherein each nozzle tip includes a hexahedron defining the cavitation generating hole, thin-plate-like mounting portions extending from two opposing surfaces of the hexahedron except for the surfaces where there are a small-diameter end and a large-diameter end of the cavitation generating hole, and a protruding portion defining a flow passage communicating with the small-diameter end of the cavitation generating hole, wherein a recess of a contour corresponding to the configuration of the nozzle tip is formed in the head main body portion, and wherein the nozzle tip can be inserted into the recess and mounted to the head main body portion by the mounting portion.

13. A scale removing device for a steam generator according to claim 10, wherein a CCD camera is provided in the forward end portion of the cleaning head.

* * * * *